US008014711B2

(12) United States Patent
Ito et al.

(10) Patent No.: US 8,014,711 B2
(45) Date of Patent: Sep. 6, 2011

(54) FIXING UNIT HAVING ENHANCED TEMPERATURE CONTROL AND IMAGE FORMING APPARATUS USING THE SAME

(75) Inventors: Akiko Ito, Machida (JP); Tadashi Ogawa, Machida (JP); Hiroshi Seo, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 662 days.

(21) Appl. No.: 11/882,158

(22) Filed: Jul. 31, 2007

(65) Prior Publication Data

US 2008/0025773 A1 Jan. 31, 2008

(30) Foreign Application Priority Data

Jul. 31, 2006 (JP) ..... 2006-207614

(51) Int. Cl.

| | |
|---|---|
| ***G03G 15/16*** | (2006.01) |
| ***G03G 15/20*** | (2006.01) |
| ***H05B 11/20*** | (2006.01) |
| ***H05G 6/12*** | (2006.01) |

(52) U.S. Cl. ..... 399/328; 399/122; 399/320; 399/330; 399/333; 219/216; 219/219; 219/619; 219/643

(58) Field of Classification Search ..... 399/328, 399/122, 320, 400; 219/219, 469, 619, 643
See application file for complete search history.

(56) References Cited

U.S. PATENT DOCUMENTS

| | | | | |
|---|---|---|---|---|
| 5,568,240 | A | 10/1996 | Ohtsuka | |
| 5,765,086 | A * | 6/1998 | Kishino et al. | 399/329 |
| 5,778,293 | A | 7/1998 | Ohtsuka | |
| RE38,810 | E * | 10/2005 | Terada et al. | 399/328 |
| 7,006,781 | B2 * | 2/2006 | Imai et al. | 399/333 |
| 7,194,234 | B2 * | 3/2007 | Katakabe et al. | 399/330 |
| 7,664,451 | B2 * | 2/2010 | Baba et al. | 399/329 |
| 7,778,581 | B2 * | 8/2010 | Seo et al. | 399/328 |
| 7,783,240 | B2 * | 8/2010 | Ito et al. | 399/328 |
| 7,796,931 | B2 * | 9/2010 | Yasuda et al. | 399/328 |
| 7,801,457 | B2 * | 9/2010 | Seo et al. | 399/69 |
| 2004/0105708 | A1 | 6/2004 | Imai et al. | |
| 2006/0099015 | A1 * | 5/2006 | Miyazaki | 399/328 |

(Continued)

FOREIGN PATENT DOCUMENTS

| | | |
|---|---|---|
| CN | 1115432 | 1/1996 |

(Continued)

OTHER PUBLICATIONS

European Search Report dated Mar. 22, 2010 for corresponding European Application No. 07252982.9.

(Continued)

*Primary Examiner* — David M Gray
*Assistant Examiner* — Francis Gray
(74) *Attorney, Agent, or Firm* — Harness, Dickey & Pierce, P.L.C.

(57) ABSTRACT

A fixing unit includes a rotatable fixing member and a rotatable pressure applying member. The rotatable fixing member has a heat generating layer to generate heat when subject to a magnetic flux. The rotatable pressure applying member contacts the rotatable fixing member and applies pressure to the fixing member. The rotatable fixing member and the rotatable pressure applying member form a nip therebetween, to which a recording medium is passed through to fix an image on the recording medium. The rotatable fixing member includes a magnetism regulating layer deformable when subject to pressure from the rotatable pressure applying member.

33 Claims, 7 Drawing Sheets

U.S. PATENT DOCUMENTS

| | | | | |
|---|---|---|---|---|
| 2006/0165429 | A1 | 7/2006 | Satoh et al. | |
| 2007/0127958 | A1* | 6/2007 | Matsuura et al. | 399/328 |
| 2007/0242988 | A1* | 10/2007 | Seo et al. | 399/328 |

FOREIGN PATENT DOCUMENTS

| | | |
|---|---|---|
| CN | 1504065 | 6/2004 |
| JP | 4-264479 | 9/1992 |
| JP | 8-129313 | 5/1996 |
| JP | 2000-039797 | 2/2000 |
| JP | 2001-013805 | 1/2001 |
| JP | 2004-151470 | 5/2004 |

OTHER PUBLICATIONS

Office Action dated Mar. 27, 2009 for corresponding Chinese Patent Application No. 200710137388X.

* cited by examiner

FIXING UNIT HAVING ENHANCED TEMPERATURE CONTROL AND IMAGE FORMING APPARATUS USING THE SAME

TECHNICAL FIELD

The present disclosure relates to a fixing unit for an image forming apparatus, and more particularly, to a fixing unit using electromagnetic induction heating method.

BACKGROUND

An image forming apparatus such as copying machine, printer, facsimile, printing machine, and multi-functional apparatus may produce an image by transferring a visible image (e.g., toner image) from an image carrier to a recording sheet.

Such a visible image (e.g., toner image) may be fixed on a recording sheet by applying heat and/or pressure to the recording sheet when the recording sheet passes through a fixing unit.

Such a fixing unit may employ a heat roller type or a belt fixing type as heat applying method, for example.

The heat roller type may include a heating roller having a heat source (e.g., halogen lamp) and a pressure roller contactable to the heating roller, wherein heating roller and the pressure roller may form a fixing nip therebetween.

The belt fixing type may include a belt as heat applying member, wherein the belt may have a heat capacitance smaller than a roller.

Further, a fixing unit may employ an electromagnetic induction heating method as heat applying method.

In an electromagnetic induction heating method, a heating roller may include an induction coil therein. When an electric current is applied to the induction coil, an eddy current may be induced in the heating roller when subject to magnetic field generated by the induction coil, by which the heating roller may be heated.

Such a configuration may not need a preheating process for the heating roller, which may be conducted for conventional heat roller type. Accordingly, such an electromagnetic induction heating method may increase a temperature of the heating roller to a given temperature instantaneously.

The induction coil may be applied with a high frequency voltage by a high frequency power source, and the heat roller may include a heat generating layer having magnetic property. The heat generating layer may be heated to a fixing temperature, set approximately to a Curie temperature of the magnetic material used for the heat generating layer, for example.

In such a configuration, when the induction coil is applied with a high frequency voltage by the high frequency power source, the heat generating layer may generate heat.

In such a configuration, a ferromagnetic material contained in the heat generating layer may be heated and generate a magnetic field by the induction coil, and a temperature of the heat generating layer may be instantaneously increased until the ferromagnetic material may be heated to the Curie temperature.

When the temperature of the ferromagnetic material may become the Curie temperature, the ferromagnetic material may lose its magnetic property. When ferromagnetic material loses its magnetic property, the temperature of the ferromagnetic material may not be increased, but may be maintained at a given temperature level.

As above-mentioned, a fixing temperature of the heat generating layer having the ferromagnetic material may be set in a range corresponding the Curie temperature. Accordingly, the fixing temperature of the ferromagnetic material may be maintained at the temperature, which may approximately correspond to the Curie temperature.

Such a fixing unit may have a relatively higher surface releasing-ability and heat resistance of a heat roller.

Furthermore, such a fixing unit may not need a complex control unit, and may shorten a start-up time of heat roller and may control a temperature of a heat roller with a relatively higher precision.

Such a heat roller may be configured with a core metal and resin material layer. When making such a heat roller, a core metal having different shapes and resin material layer having different thicknesses may be used depending on a design concept of a fixing unit. Accordingly, such a heat roller may have a heat capacitance, which may be different from other heat roller having different core metal and resin material layer.

In such a heat roller, a content ratio of ferromagnetic material in a heating layer may be set to a value to adjust or control a start-up time and temperature at a given level.

Further, because the ferromagnetic material may lose its magnetic property at the Curie temperature, toners having magnetic particles may not be attracted to the heat roller with magnetic force of ferromagnetic material at such timing, by which a offset phenomenon or the like may not occur.

Such a fixing unit may be further improved in overheat prevention, and separatability of recording medium, for example.

SUMMARY

The present disclosure relates to a fixing unit including a rotatable fixing member and a rotatable pressure applying member. The rotatable fixing member has a heat generating layer to generate heat when subject to a magnetic flux. The rotatable pressure applying member contacts the rotatable fixing member and applies pressure to the fixing member. The rotatable fixing member and the rotatable pressure applying member form a nip therebetween, through which a recording medium is passed to fix an image on the recording medium. The rotatable fixing member includes a magnetism regulating layer deformable when subject to pressure from the rotatable pressure applying member.

The present disclosure also relates to an image forming apparatus having a fixing unit including a rotatable fixing member and a rotatable pressure applying member. The rotatable fixing member has a heat generating layer to generate heat when subject to a magnetic flux. The rotatable pressure applying member contacts the rotatable fixing member and applies pressure to the fixing member. The rotatable fixing member and the rotatable pressure applying member form a nip therebetween, through which a recording medium is passed to fix an image on the recording medium. The rotatable fixing member includes a magnetism regulating layer deformable when subject to pressure from the rotatable pressure applying member.

BRIEF DESCRIPTION OF DRAWINGS

A more complete appreciation of the disclosure and many of the attendant advantages and features thereof can be readily obtained and understood from the following detailed description with reference to the accompanying drawings, wherein.

Figure 1:
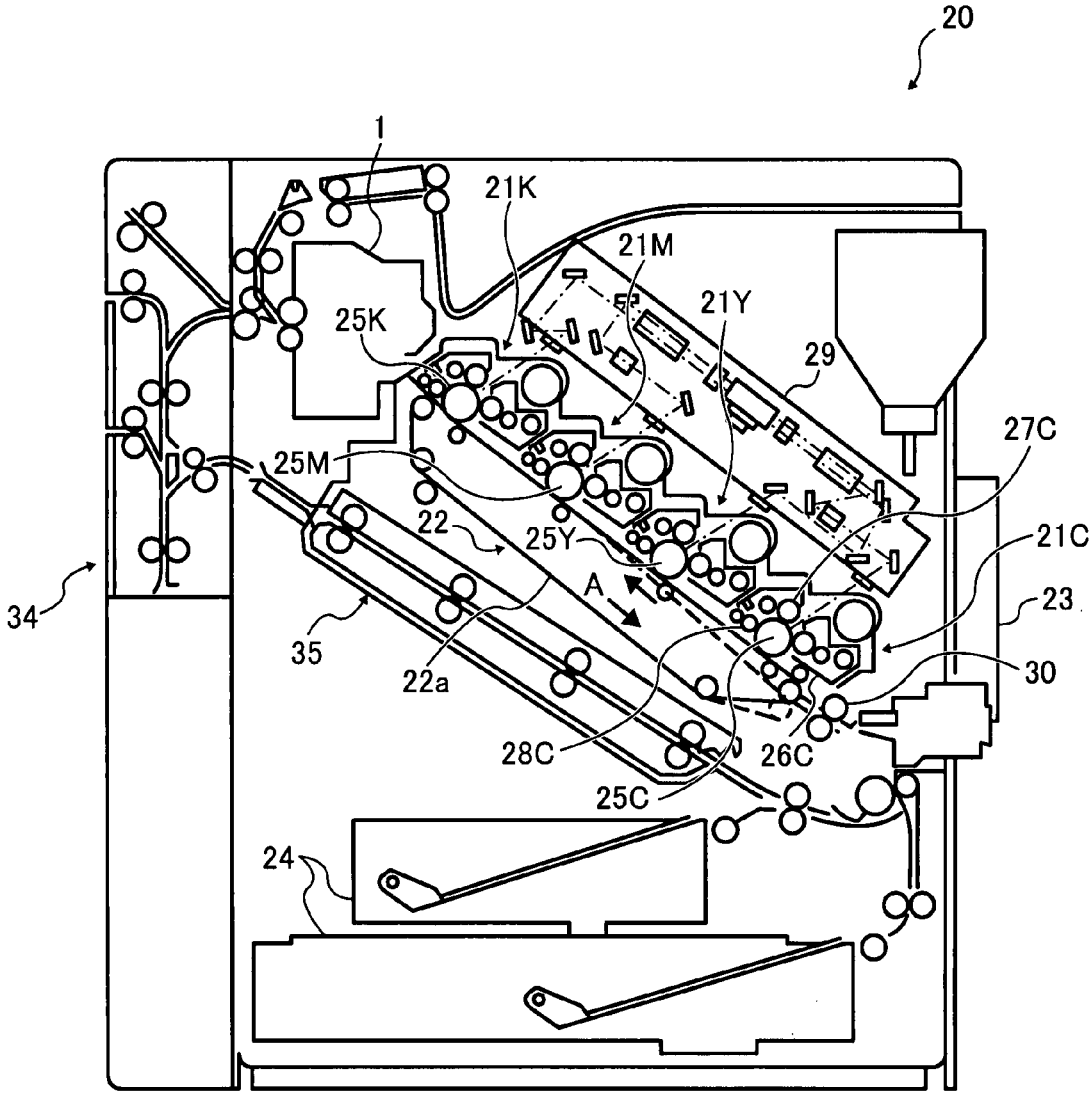
FIG. 1 is a schematic configuration of an image forming apparatus having a fixing unit according to an example embodiment.

The accompanying drawings are intended to depict example embodiments of the present disclosure and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there is no intervening elements or layers present.

Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an example embodiment is described with particular reference to FIG. 1.

FIG. 1 shows an image forming apparatus 20 having a fixing unit according to an example embodiment. Although the image forming apparatus 20 includes a copying machine or printer having four processing units arranged in a tandem manner for full color image forming, the image forming apparatus 20 may also include other types of machines such as monochrome image forming machine, for example.

The image forming apparatus 20 shown in FIG. 1 may employ a direct image forming method, for example. In such a direct image forming method, each color image may be formed as a latent image on each image carrier and developed as visible image (e.g., toner color image), and then a visible image for each color may be superimposingly transferred to a recording sheet, transported by a transport belt.

As shown in FIG. 1, the image forming apparatus 20 may include image forming units 21Y, 21M, 21C, 21K, a transfer unit 22, a manual feed tray 23, a sheet cassette 24, a registration roller 30, and a fixing unit 1, for example.

The image forming unit 21Y, 21M, 21C, 21K may form respective color image corresponding to an original document image. Hereinafter, Y, M, C, and K represent color of yellow, magenta, cyan, and black, respectively.

The transfer unit 22 may face each of the image forming units 21Y, 21M, 21C, and 21K, and may form an image transfer nip with each of the image forming units 21Y, 21M, 21C, and 21K.

The manual feed tray 23 may be used to feed a sheet in a manual mode. The sheet cassette 24 may have two cassettes, for example, as shown in FIG. 1.

The registration roller 30 may feed a recording sheet, transported from the sheet cassette 24, to an image transfer nip for each of the image forming unit 21Y, 21M, 21C, and 21K with adjusting such a sheet feed timing with an image forming timing of each of the image forming unit 21Y, 21M, 21C, and 21K.

The fixing unit 1 may fix images on the recording sheet, which may be transferred with visible images (e.g., toner images) at the image transfer nip. In an example embodiment, the fixing unit 1 may fix toner images on a recording sheet having an unfixed toner images thereon.

In addition to such a fixing method, an image forming apparatus according to an example embodiment may employ a trans-fix unit, which may transfer toner images on a recording sheet and fix the toner images on the recording sheet at a substantially same timing, for example.

The fixing unit 1, to be described later, may have a configuration having a pair of rollers used for fixing an image (e.g., toner image) on a recording sheet. For example, the fixing unit 1 may include a fixing roller and a pressure roller, for example. The fixing roller may have a heat source therein, and the pressure roller may apply pressure to the fixing roller by contacting the fixing roller.

The transfer unit 22 may include a transport belt 22*a*, a transfer biasing voltage applier (not shown), and an adsorption bias voltage applier, for example.

The transport belt 22*a*, extended by a plurality of rollers, may transport a recording sheet by adsorbing the sheet on the transport belt 22*a*.

The transfer biasing voltage applier (not shown), disposed at a position facing a photoconductor drum for each of the image forming units 21, may apply transfer biasing voltage to the recording sheet.

Furthermore, the adsorption bias voltage applier may be disposed at a sheet entrance side of the transfer unit 22. Such an adsorption bias voltage applier may apply adsorption bias voltage to a recording sheet to adhere the recording sheet on the transport belt 22*a*.

The transport belt 22*a*, having the recording sheet thereon, may travel in a direction shown by an arrow A in FIG. 1, and the recording sheet may be transferred with toner images from the image forming unit 21Y, 21M, 21C, and 21K during such traveling.

The image forming units 21Y, 21M, 21C, and 21K may conduct a developing process for images of yellow, magenta, cyan, and black, respectively, and may have a similar configuration one another. Accordingly, the image forming unit 21C may be explained as a representative of the image forming units 21Y, 21M, 21C, and 21K, hereinafter.

The image forming unit 21C may include a photoconductor drum 25C, a developing unit 26C, a charging unit 27C, and a cleaning unit 28C, for example.

The photoconductor drum 25C may be used as image carrier, which carries an electrostatic latent image thereon. An image carrier having a belt shape may also be used instead of drum shape.

As shown in FIG. 1, the charging unit 27C, the developing unit 26C, and the cleaning unit 28C may be disposed around the photoconductor drum 25C.

The charging unit 27C may charge the surface of the photoconductor drum 25C uniformly.

A writing unit 29 may emit a light beam to the charged photoconductor drum 25C to write an electrostatic latent image on the charged photoconductor drum 25C corresponding to image data.

The developing unit 26C may develop the electrostatic latent image as visible image (e.g., toner image) on the photoconductor drum 25C.

As shown in FIG. 1, the transfer unit 22 may be installed in the image forming apparatus 20 in a slanted manner, by which an occupying space of image forming apparatus 20 in a horizontal direction may be reduced.

In such a configured image forming apparatus 20, an image forming operation may be conducted as below. Hereinafter, an image forming operation may be explained with the image forming unit 21C using cyan toner. Other image forming units may similarly conduct image forming operations.

A main motor (not shown) may drive the photoconductor drum 25C. The photoconductor drum 25C, rotated by the main motor (not shown), may be de-charged by a de-charger (not shown), and a surface potential of photoconductor drum 25C may be set to a reference potential such as approximately −50V.

The charging unit 27C may apply AC bias voltage, superimposed with DC bias voltage, to the photoconductor drum 25C to uniformly charge the surface potential of the photoconductor drum 25C to a given charging potential such as −500V to −700V. The charging potential may be determined by a process controlling unit.

The writing unit 29 may irradiate a laser beam to write an electrostatic latent image on the photoconductor drum 25C, charged uniformly by the above-mentioned charging process. The writing unit 29 may write an electrostatic latent image corresponding to image information transmitted from an image controller (not shown). The writing unit 29 may include a light source, a polygon mirror, an f-theta lens, for example.

The light source may emit a laser beam corresponding to image information transmitted from the image controller. The light source may include a laser diode, for example.

The laser beam, passing a cylinder lens, polygon mirror, f-theta lens, mirrors, and other lens, may irradiate a surface of the photoconductor drum 25C.

Such a photoconductor drum 25C may have a surface area having a surface potential of approximately −50V by such irradiation, by which an electrostatic latent image corresponding to the image information may be formed on the photoconductor drum 25C.

The developing unit 26C may develop the electrostatic latent image on the photoconductor drum 25C with toners as visible image. In the developing process, a developing sleeve of the developing unit 26C may be applied with DC −300V to −500V superimposed with AC bias voltage.

The developing unit 26C may develop a toner image having a given charge (e.g., Q/M: −20 μC/g to −30 μC/g) on an area having a relatively lower potential due to the irradiation of light beam.

The toner image developed by such a developing process may be transferred to a recording sheet. The recording sheet may be fed to an image transferring nip by the registration roller 30. The registration roller 30 may temporarily stop a movement of the recording sheet before feeding the recording sheet to the image transferring nip.

The recording sheet may be applied with an adsorption bias voltage by the adsorption bias voltage applier, which may be disposed at a sheet entry side of the transport belt 22*a*. The adsorption bias voltage applier may be configured as roller unit. With such a process, the recording sheet may be electrostatically adsorbed on the transport belt 22*a*. The recording sheet adsorbed on the transport belt 22*a* may travel with the transport belt 22*a* in a direction show by an arrow A in FIG. 1.

When the recording sheet comes to a position facing a photoconductor drum 25 of each image forming unit 21, the transfer biasing voltage applier may apply bias voltage, which has an opposite polarity of toner, to the recording sheet to electrostatically transfer the toner image from the photoconductor drum 25.

After such an image transferring operation is finished, the recording sheet may be separated from the transport belt 22*a*, and transported to the fixing unit 1.

The fixing unit 1 may include a fixing roller and a pressure roller, which may be configured to form a fixing nip therebetween. When the recording sheet passes through the fixing nip, toner images may be fixed on the recording sheet.

After the toner image is fixed on the recording sheet, the recording sheet may be ejected to an in-apparatus ejection tray or to an outer ejection tray (not shown). The in-apparatus ejection tray may mean a space provided in a body of an image forming apparatus. Because such in-apparatus ejection tray may not protrude from the body of an image forming apparatus, an occupying space of such an image forming apparatus having an in-apparatus ejection tray may be reduced.

The image forming apparatus 20 shown in FIG. 1 may have a configuration that may form an image on both faces of recording sheet.

As shown in FIG. 1, the image forming apparatus 20 may include a double-face reversing unit 34 and a reversing transport unit 35. When a double-face image forming mode may be selected, the recording sheet passed through the fixing unit 1 may be transported to the double-face reversing unit 34, in which a face orientation of the recording sheet may be reversed, and the recording sheet may be transported to the reversing transport unit 35.

The recording sheet may be further transported to the registration roller 30, similar to one-face image forming, and the registration roller 30 may feed the recording sheet to the image transfer nip at a given timing.

The recording sheet having images on both faces may pass through the fixing unit 1, and may be ejected to the above-mentioned sheet ejection tray similar to the one-face image forming.

Figure 2:
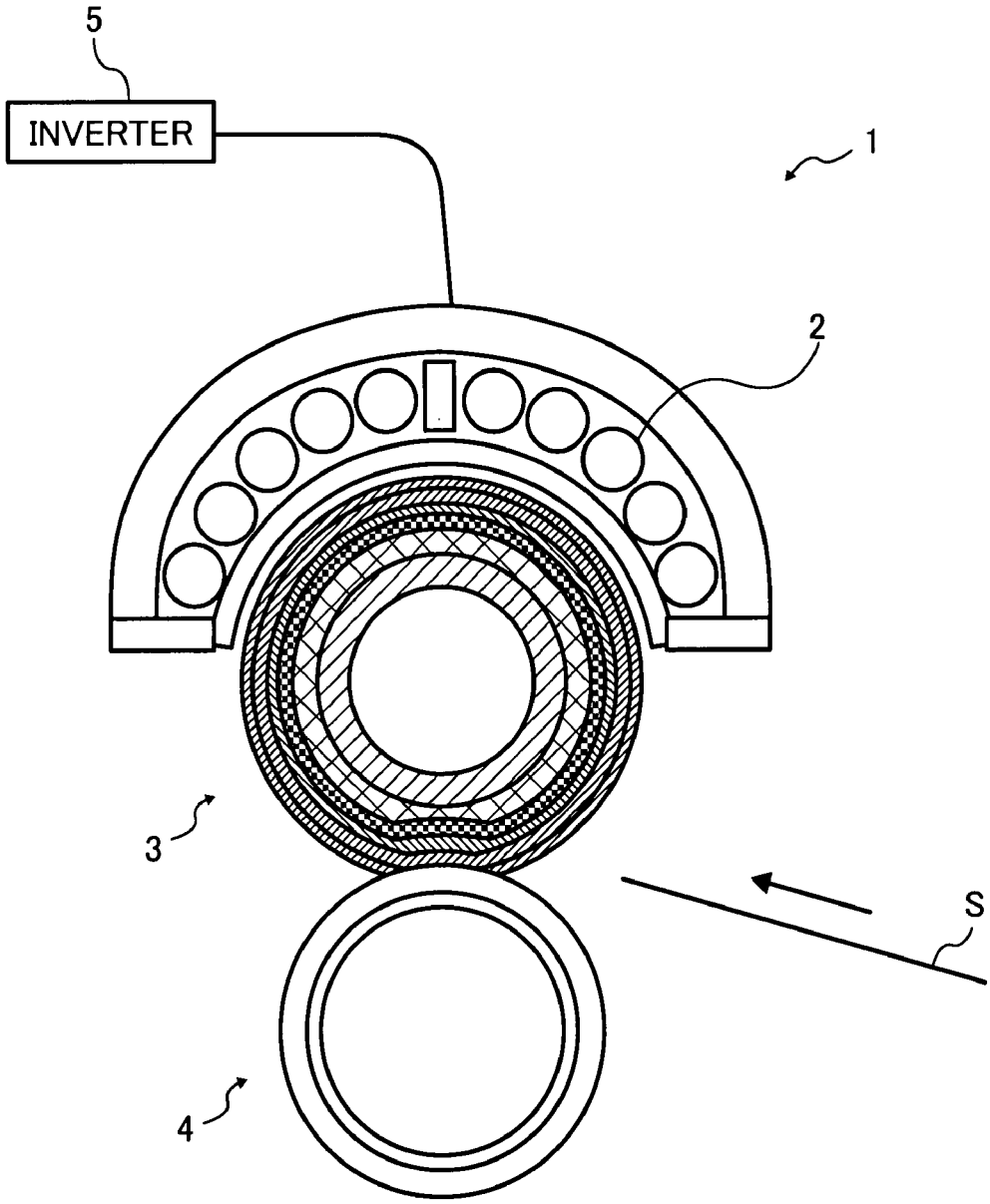
FIG. 2 is a schematic cross-sectional view of a fixing unit included in an image forming apparatus of FIG. 1.

FIG. 2 illustrates a schematic cross-sectional view of the fixing unit 1 used in the image forming apparatus 20. The fixing unit 1 may be configured with rollers, for example.

As shown in FIG. 2, the fixing unit 1 may include a magnetic flux generating coil 2, a fixing roller 3, a pressure roller 4, an inverter 5, for example. The fixing unit 1 may be used to fix an image on a recording medium S.

The magnetic flux generating coil 2 may generate magnetic flux when an electric current flows in the coil. Hereinafter, the magnetic flux generating coil 2 may be referred as "flux generator 2" for simplicity of expression.

The fixing roller 3 may be a fixing member of rotating type, which may include a metal material, for example. The pressure roller 4 may be a pressure applying member of rotating type.

In the fixing unit 1, the inverter 5 used as induction heating circuit may drive the flux generator 2 with high frequency wave to generate a magnetic field having a high frequency wave.

Such a magnetic field may induce an eddy current on the fixing roller 3, including metal material, by which a temperature of the fixing roller 3 may be increased.

Figure 3:
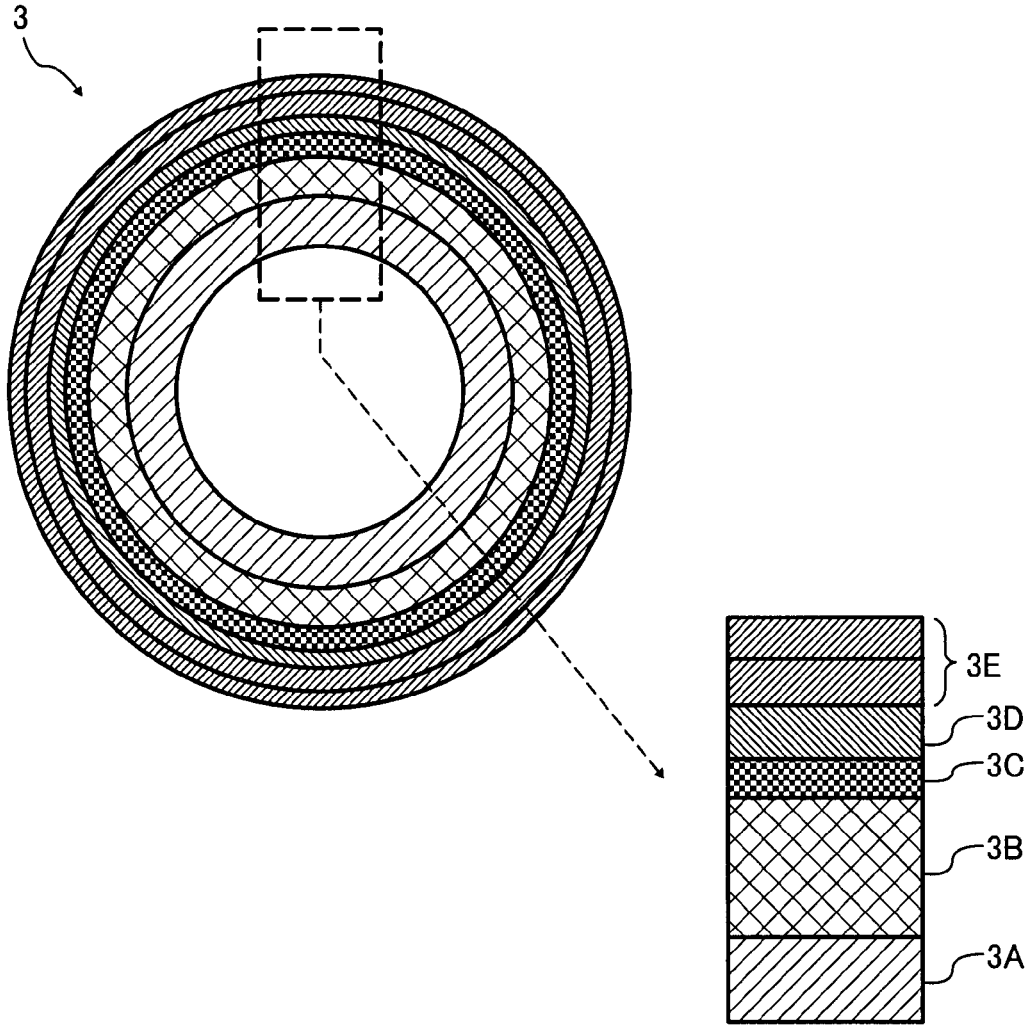
FIG. 3 is a schematic cross-sectional view of a fixing roller in FIG. 2.

FIG. 3 illustrates a schematic cross-sectional view of the fixing roller 3, and a partially expanded view of the fixing roller 3. The fixing roller 3 may include a core metal 3A, a heat-insulating layer 3B, a magnetism regulating layer 3C, a heat generating layer 3D, and a surface layer 3E, for example, as shown in FIG. 3.

The heat-insulating layer 3B may be made of an elastic material, for example.

The magnetism regulating layer 3C and the heat generating layer 3D may be provided as different layers, for example.

The core metal 3A may be made of metal material such as aluminum or aluminum alloy, for example.

The surface layer 3E may be made of a resinous material such as silicone rubber and PFA (perfluoroalkoxy), for example.

The magnetism regulating layer 3C may be made of magnetic materials having a given Curie temperature such as 100 to 300 degree Celsius, for example. The Curie temperature may be set to a given value, as required, by adjusting a content of magnetic materials. The magnetism regulating layer 3C may prevent or suppress an overheating of the heat generating layer 3D or the like, which will be described later.

Figure 4:
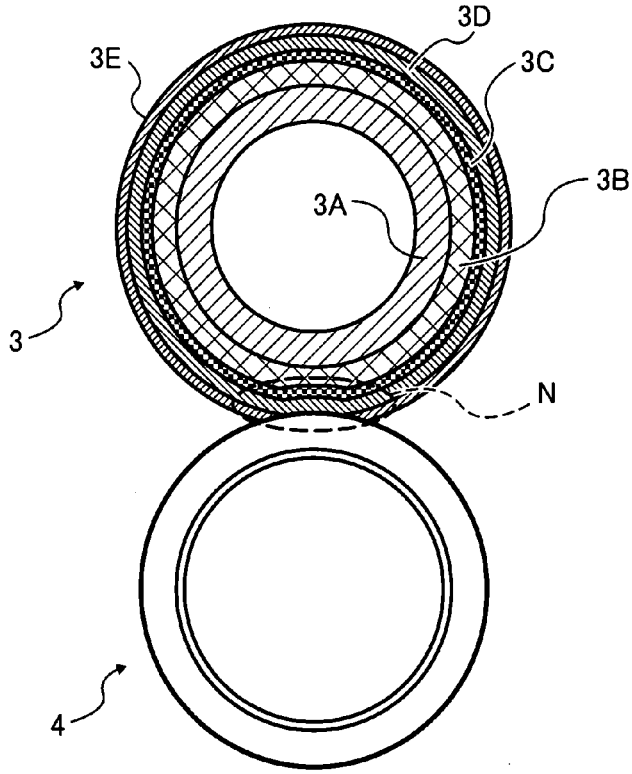
FIG. 4 is a schematic cross-sectional view of a pressure applying member and a fixing roller, in which a heat-insulating layer, and a magnetism regulating layer is deformed with pressure.

As shown in FIG. 4, the fixing roller 3 may form a fixing nip N with the pressure roller 4. The fixing roller 3 may deform at the fixing nip N when subject to pressure from the pressure roller 4 as shown in FIG. 4. Because the fixing roller 3 may deform at the fixing nip N with a concave-like shape as shown in FIG. 4, a separatability of the recording medium S from the fixing nip N may be enhanced.

In an example embodiment, the heat-insulating layer 3B, the magnetism regulating layer 3C, the heat generating layer 3D, and the surface layer 3E may be deformed by a pressure effect of the pressure roller 4 at the fixing nip N. The core metal 3A may not be deformed when subject to pressure from the pressure roller 4.

Figure 5:
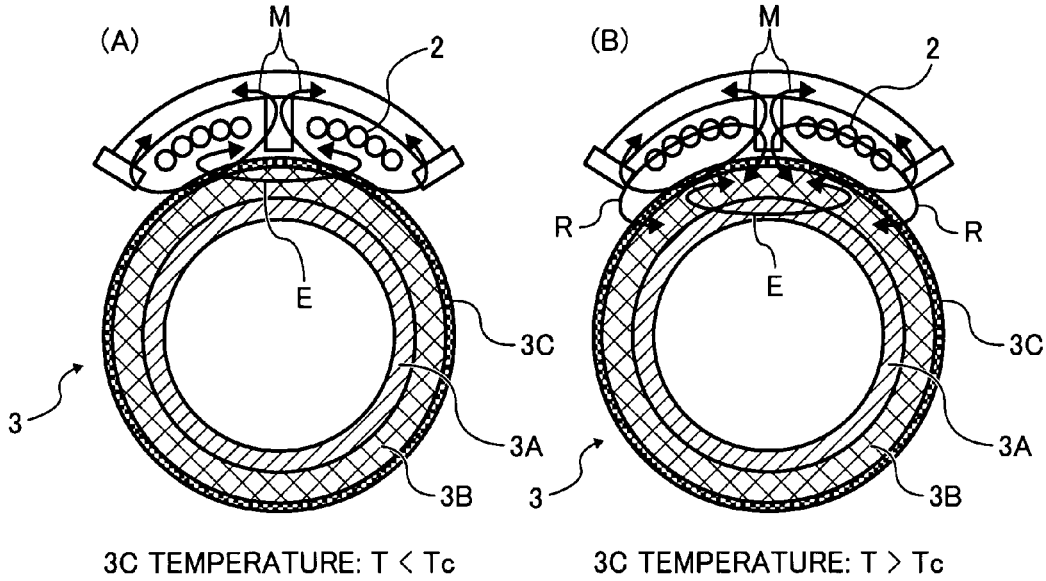
FIG. 5(A) shows a schematic cross-sectional view of a fixing member, in which a magnetic flux does not penetrate a magnetism regulating layer, and FIG. 5(B) a schematic cross-sectional view of a fixing member, in which a magnetic flux penetrates a magnetism regulating layer.

FIGS. 5(A) and 5(B) show a schematic cross-sectional view of the fixing roller 3 having different temperature conditions.

As shown in FIG. 5(A), the flux generator 2 may generate magnetic flux (as depicted by an arrow M) and an eddy current (as depicted by an arrow E) to be generated on the fixing roller 3 when subject to the magnetic flux M.

The magnetism regulating layer 3C, made of metal alloy, may regulate an effect of the magnetic flux M generated by the flux generator 2 as below.

FIG. 5(A) shows a state that the magnetism regulating layer 3C has a temperature T, which is less than a Curie temperature Tc (i.e., $T<Tc$). Under a condition of "$T<Tc$," the magnetism regulating layer 3C may have a magnetic property. Such a condition may mean that the magnetic flux generated by the flux generator 2 may not penetrate through the magnetism regulating layer 3C.

Accordingly, the magnetism regulating layer 3C having a temperature less than the Curie temperature Tc may block the magnetic flux, by which the magnetic flux may not penetrate to the core metal 3A.

FIG. 5(B) shows a state that the magnetic flux penetrates to the core metal 3A via the magnetism regulating layer 3C. In FIG. 5(B), another magnetic flux may be generated by the core metal 3A (e.g., aluminum or aluminum alloy), which is expressed by an arrow R.

FIG. 5(B) shows a state that the magnetism regulating layer 3C has a temperature T, which is greater than the Curie temperature Tc ($T>Tc$). Under a condition of "$T>Tc$," the magnetism regulating layer 3C may lose a magnetic property, and may be in a non-magnetic condition. Such a condition may mean that the magnetic flux generated by the flux generator 2 may penetrate to the core metal 3A although the magnetism regulating layer 3C and heat-insulating layer 3B are still present.

The magnetism regulating layer 3C including magnetic material may maintain magnetic property until the temperature reaches the Curie temperature Tc, and may lose magnetic property when the temperature becomes greater than the Curie temperature Tc.

Therefore, when a temperature of magnetism regulating layer 3C is smaller than the Curie temperature Tc, the magnetism regulating layer 3C may increase its temperature instantaneously, and when a temperature of magnetism regulating layer 3C becomes greater than the Curie temperature Tc, the magnetism regulating layer 3C may not increase its temperature but may maintain the temperature at a given level.

When the magnetism regulating layer 3C may be formed of a magnetic material having a given Curie temperature (e.g., 100 to 300 degree Celsius), which may correspond to a fixing temperature range of the fixing unit 1, the heat generating layer 3D and core metal 3A of the fixing roller 3 may not be overheated, but the fixing temperature of the fixing unit 1 may be maintained at a given level while maintaining a desired level of releasing-ability on the surface of fixing roller 3 and heat resistance of fixing roller 3.

Furthermore, such a configuration may not need complex processing for temperature control of the fixing unit 1.

The magnetism regulating layer 3C may be formed as a single layer. In such a case, the magnetism regulating layer 3C may be deformable if the magnetism regulating layer 3C may be made of material such as alloy having iron and nickel and may have a given thickness such as 150 μm or less, for example. Under such conditions, the magnetism regulating layer 3C may be effectively deformable.

Figure 6:
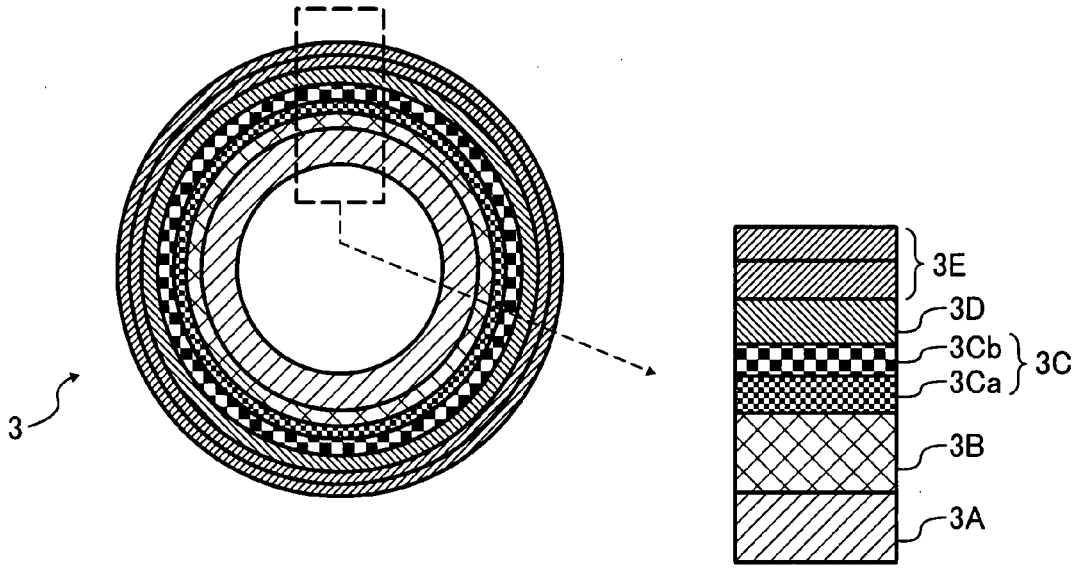
FIG. 6 is a schematic cross-sectional view of a fixing member having a magnetism regulating layer and a coating layer coated on the magnetism regulating layer.

Furthermore, as shown in FIG. 6, the magnetism regulating layer 3C may formed as double (or multiple) layers having a base layer 3Ca and a magnetic layer 3Cb coated on the base layer 3Ca. The base layer 3Ca may be made of a deformable material. Such a double (or multiple) layer configuration may effectively deform the magnetism regulating layer 3C, and may reduce or suppress breaking of the magnetism regulating layer 3C.

Furthermore, the heat-insulating layer 3B, provided inside of the magnetism regulating layer 3C as shown in FIGS. 3 and 6, may be made of material having a lower heat conductivity compared to the magnetism regulating layer 3C. Such a configuration may enhance heating efficiency of the heat generating layer 3D.

The heat-insulating layer 3B may be made of a material having a lower heat conductivity compared to the magnetism regulating layer 3C.

For example, the magnetism regulating layer 3C may be made to have a heat conductivity of 11 W/mK, and the heat-insulating layer 3B may be made to have a heat conductivity of 0.1 W/mK, which may be made of foamed silicone rubber. Further, the heat-insulating layer 3B may be an air space having a heat conductivity of 0.077 W/mK, for example.

In an example embodiment, the heat-insulating layer 3B used as heat insulating zone may or may not include an elastic member. If the heat-insulating layer 3B may include an elastic member, a nip pressure caused by the pressure roller 4 may be enhanced, by which a fixing-ability at the fixing nip may be enhanced.

In an example embodiment, the heat-insulating layer 3B may have a given thickness of 10 mm or less, or the heat-insulating layer 3B may have a given thickness, computed from factors such as magnetic flux intensity or other factors.

With such a heat-insulating layer 3B having a given thickness, a magnetic flux, which may passes through the magnetism regulating layer 3C, may penetrate to a conductive material (e.g., core metal 3A).

Further, such a heat-insulating layer 3B may have a given thickness of 1 mm or more, for example, 3 mm or more. The heat-insulating layer 3B having a thickness of 1 mm or more may insulate heat, and the heat-insulating layer 3B having a thickness of 3 mm or more may maintain the nip pressure at a given level.

A conductive material such as core metal 3A may function as below when a temperature of the magnetism regulating layer 3C formed of a magnetic material becomes greater than a given Curie temperature.

As described above, when the temperature of the magnetism regulating layer 3C is less than a Curie temperature Tc, a magnetic flux generated by the flux generator 2 may induce an eddy current on the magnetism regulating layer 3C, by which the fixing roller 3 may be heated. In such a temperature condition, an eddy current may not be generated on the core metal 3A because the magnetic flux may not reach the core metal 3A.

On one hand, when the temperature of the magnetism regulating layer 3C becomes greater than a Curie temperature Tc, a magnetic flux generated by the flux generator 2 may induce an eddy current on the core metal 3A instead of the magnetism regulating layer 3C because the magnetism regulating layer 3C may lose magnetic property under such a temperature condition and the magnetic flux can reach the core metal 3A. Because the eddy current may not be generated in the magnetism regulating layer 3C, an overheating of the fixing unit 1 may be prevented.

Such a core metal 3A may be made of a metal material having a lower volume resistivity and be positioned as close as possible to the magnetism regulating layer 3C.

Although the magnetism regulating layer 3C may lose a magnetic property at a temperature greater than a Curie temperature Tc, an eddy current might be generated on the magnetism regulating layer 3C if such a metal material having a lower volume resistivity may not be positioned near the magnetism regulating layer 3C. Such a condition may not be preferable because the magnetism regulating layer 3C may be further heated, and the fixing unit 1 may be overheated.

Accordingly, a conductive material made of metal having a lower volume resistivity may be positioned as close as possible to the magnetism regulating layer 3C to prevent or suppress an overheating of the fixing unit 1.

Further, as described later, the fixing member may include any types such as roller, sleeve, and belt.

The fixing roller 3 shown in FIG. 3 may include the core metal 3A, heat-insulating layer 3B, magnetism regulating layer 3C, heat generating layer 3D, and surface layer 3E as one integrated roller.

However, the core metal 3A and heat-insulating layer 3B may be used as a roller unit, and the magnetism regulating layer 3C, heat generating layer 3D, and surface layer 3E may be used a sleeve unit separately in a fixing unit, as required.

If the fixing member may be a belt type, a fixing belt 40, to be described later with FIG. 9, may include a heat generating layer and a magnetism regulating layer therein, and a heating roller may include a core metal and a heat-insulating layer, for example.

Further, if the fixing member may use a belt type, such a fixing belt may include a heat generating layer having a base layer and a metal layer coated on the base layer, and a heat roller may include a magnetism regulating layer. In such a case, the magnetism regulating layer and the heat generating layer may be separately provided in a fixing unit.

In the above-described example embodiment, the flux generator 2 used as magnetic flux generator may be disposed outside the fixing roller 3 as shown in FIG. 1.

Figure 7:
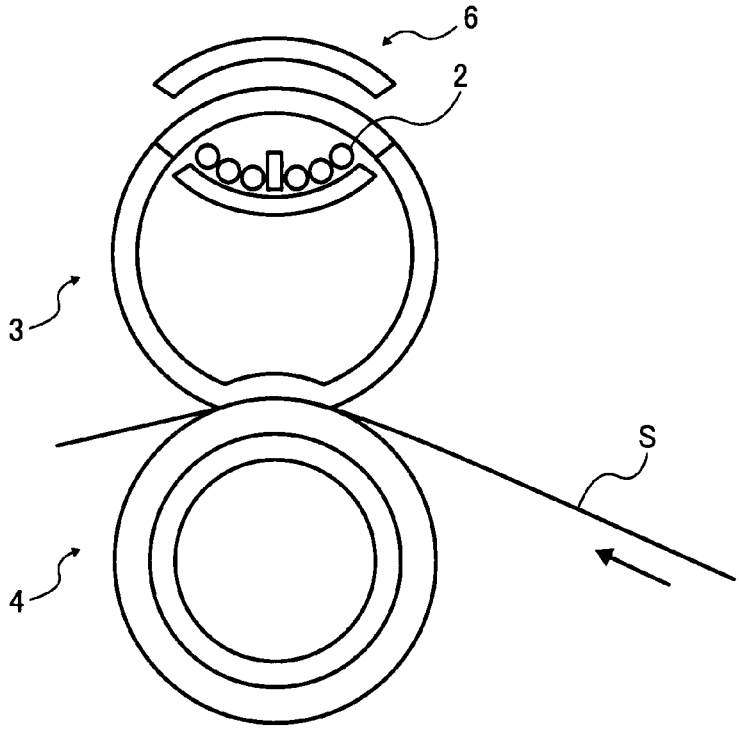
FIG. 7 is a schematic cross-sectional view of a fixing member and a coil, in which a coil is positioned inside of a fixing member.

Further, such a flux generator 2 may also be disposed inside the fixing roller 3 as shown in FIG. 7, in which a conductive material 6 may be disposed outside the fixing roller 3. The conductive material 6 may function in a similar manner of the core metal 3A for temperature control, which is explained in the above.

Figure 8:
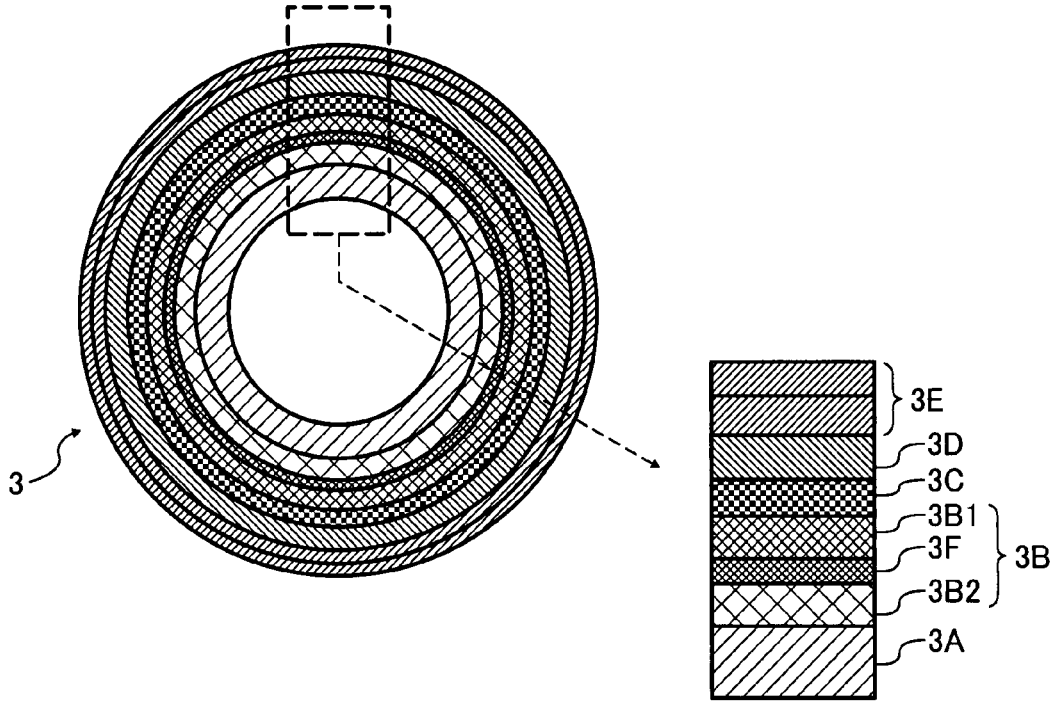
FIG. 8 is a schematic cross-sectional view of a fixing member having a heat-insulating layer configured with a plurality of layers.

FIG. 8 is another schematic cross-sectional view of the fixing roller 3. The fixing roller 3 shown in FIG. 8 may have the heat-insulating layer 3B having a multiple layer configuration, in which the heat-insulating layer 3B may include a first insulating layer 3B1, a second insulating layer 3B2, and a conductive material layer 3F (e.g., aluminum or aluminum alloy), which is sandwiched by the first insulating layer 3B1 and second insulating layer 3B2.

Although the heat-insulating layer 3B shown in FIG. 8 may include one conductive material layer 3F, the heat-insulating layer 3B may be provided with a plurality of conductive material layers, as required, with a plurality of heat insulating layers.

If the heat-insulating layer 3B may include a plurality of conductive material layers, at least an outermost conductive material layer may need to be deformed with a pressure of the pressure roller 4, and such an outermost conductive material layer may be sandwiched by heat insulating zones made of elastic member such as heat-insulating layers 3B1 and 3B2 as shown in FIG. 8. With such a configuration, a nip pressure may be maintained at a desired level.

The outermost conductive material layer may mean a conductive material layer, which is most close to a surface of the fixing roller 3 compared to other conductive material layers.

Further, the conductive material 3F and magnetism regulating layer 3C may be positioned with each other while sandwiching the heat-insulating layer 3B1 therebetween as shown in FIG. 8. Such a heat-insulating layer 3B1 may have a smaller thickness. In such a configuration, a distance between the conductive material 3F and magnetism regulating layer 3C may be set to a smaller value. Accordingly, the conductive material 3F may generate an eddy current, which may be effectively used for controlling a temperature of the fixing unit 1 when the temperature of the magnetism regulating layer 3C becomes a Curie temperature.

Accordingly, an overheating of the fixing roller 3 may be prevented and a nip pressure may be maintained at a desired level simultaneously.

In such a configuration, the outermost conductive material layer may be sandwiched by a first heat insulating zone and a second heat insulating zone, in which the first heat insulating zone is provided at an outer side compared to the second heat insulating zone in a cross-sectional configuration of the heating roller 3.

Furthermore, the first heat insulating zone may have a lower heat conductivity compared to the second heat insulating zone.

In such a configuration, even if the outermost conductive material layer may generate heat, such heat may not be transmitted to a roller surface so easily, by which an overheat of heat generating layer may be prevented or suppressed.

For example, as shown in FIG. 8, the heat-insulating layer 3B1 used as first heat insulating zone may be made of foamed silicone rubber having a heat conductivity of 0.1 W/mK, and the heat-insulating layer 3B2 used as second heat insulating zone may be made of silicone rubber having a heat conductivity of 0.5 W/mK.

Further, the fixing roller 3 may include a conductive layer, made of conductive material having a volume resistivity lower than that of the magnetism regulating layer 3C, inside the heat-insulating layer 3B. For example, such a conductive layer may be included in the heat-insulating layer 3B of the fixing roller 3 as shown in FIG. 8.

By disposing such a conductive layer having a relatively lower volume resistivity, an overheating of the heat generating layer 3B may be effectively prevented or suppressed.

Accordingly, an overheating of the fixing roller 3 may be prevented, a nip pressure may be maintained at a desired level simultaneously, and a heating efficiency of the fixing unit 1 may be enhanced.

Such a conductive layer may be attached to a magnetism regulating layer as shown in FIG. 8, or such a conductive layer may not be attached to a magnetism regulating layer but provided separately with a magnetism regulating layer (not shown).

If the conductive material may be provided separately with the magnetism regulating layer, a belt or sleeve used as fixing member may include the magnetism regulating layer, and a roller may include a conductive layer, for example.

Figure 9:
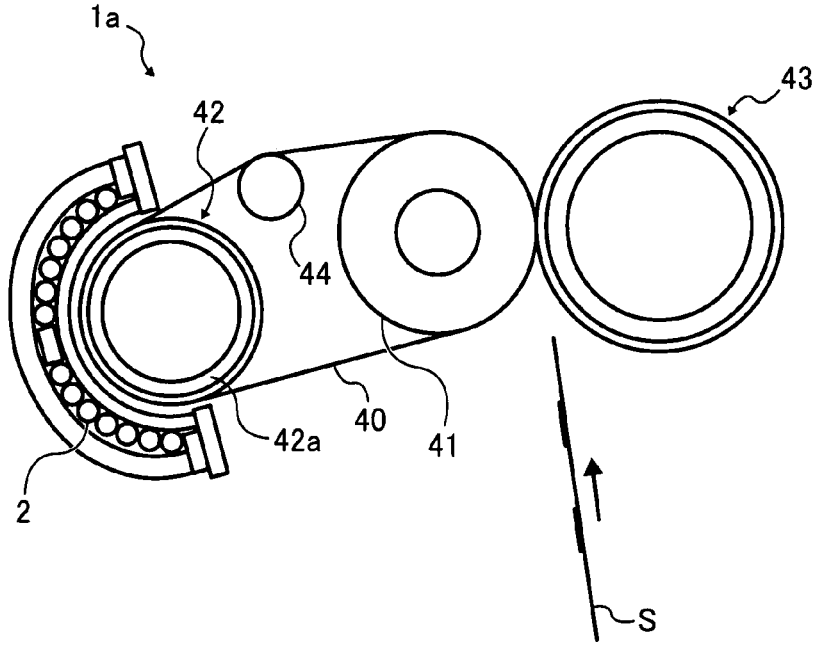
FIG. 9 and FIG. 10 are schematic cross-sectional views of other fixing members according to example embodiments, in which the fixing member is a belt type.

FIG. 9 is a schematic cross-sectional view of another fixing unit 1*a* according to an example embodiment. The fixing unit 1*a* may employ a fixing belt 40 as fixing member instead of roller, and include a fixing support roller 41, a heating roller 42, and a tension roller 44, for example. The fixing belt 40 may be extended by the fixing support roller 41, the heating roller 42, and the tension roller 44.

The fixing support roller 41 may form a fixing nip with a pressure applying member 43 via the fixing belt 40, and the flux generator 2 may be disposed near the heating roller 42. The pressure applying member 43 may include a rotatable member such as pressure roller.

Although not shown, the fixing belt 40 may include a heat generating layer and a magnetism regulating layer, and the heating roller 42 may include a core metal 42A made of metal such as aluminum or aluminum alloy, for example.

Such a fixing unit 1*a* may function in a similar manner of the above-described fixing unit 1.

Figure 10:
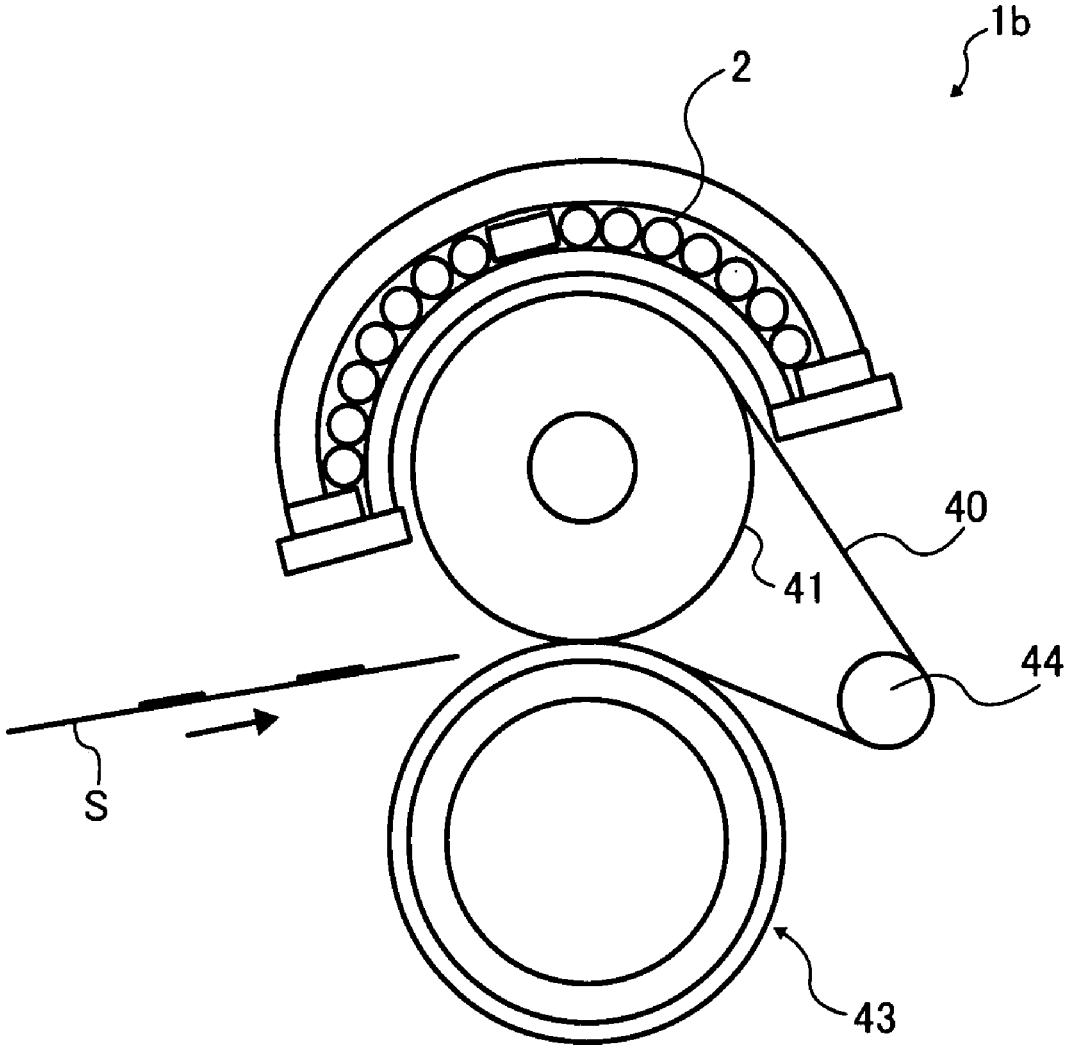

FIG. 10 is a schematic cross-sectional view of another fixing unit 1*b* according to an example embodiment. As similar to FIG. 9, the fixing unit 1*b* may employ the fixing belt 40 as fixing member.

In the fixing unit 1*b*, the fixing belt 40 may be extended by the fixing support roller 41 and the tension roller 44, and the flux generator 2 may be disposed near the fixing support roller 41, for example. Although not shown, the fixing belt 40 may include a heat generating layer, and the fixing support roller 41 may include a magnetism regulating layer.

Such a fixing unit 1*b* may function in a similar manner of the above-described fixing units 1 and 1*a*.

Numerous additional modifications and variations are possible in light of the above teachings. It is therefore to be understood that within the scope of the appended claims, the present disclosure may be practiced otherwise than as specifically described herein.

This application claims priority from Japanese patent application No. 2006-207614 filed on Jul. 31, 2006 in the Japan Patent Office, the entire contents of which is hereby incorporated by reference herein.

What is claimed is:

1. A fixing unit, comprising:

a rotatable fixing member having a core metal made of aluminum or aluminum alloy, a heat insulating layer, a magnetism regulating layer, and a heat generating layer from an inner side to an outer side of the rotatable fixing member in such order, the heat generating layer generates heat when subject to a magnetic flux generated by a magnetic flux generator disposed outside of the rotatable fixing member; and a rotatable pressure applying member configured to contact the rotatable fixing member and to apply pressure to the fixing member, the rotatable fixing member and the rotatable pressure applying member forming a nip therebetween, through which a recording medium is passed through to fix an image on the recording medium, wherein the magnetism regulating layer is deformable when subject to pressure from the rotatable pressure applying member, and is made of a magnetic material having a Curie temperature of 100 to 300 degrees Celsius, and the heat insulating layer has a thickness of 10 mm or less.

2. The fixing unit according to claim 1, wherein the magnetism regulating layer is a single layer, made of alloy material including iron and nickel, and the single layer has a thickness deformable when subject to pressure from the rotatable pressure applying member.

3. The fixing unit according to claim 2, wherein the magnetism regulating layer has a thickness of 150 μm or less.

4. The fixing unit according to claim 1, wherein the magnetism regulating layer is coated on a base layer, which is deformable when subject to pressure from the rotatable pressure applying member.

5. The fixing unit according to claim 1, wherein the heat insulating layer has a lower heat conductivity compared to the magnetism regulating layer.

6. The fixing unit according to claim 5, wherein the magnetism regulating layer has a heat conductivity of 11 W/mK, and the heat insulating layer includes a foamed silicone rubber having a heat conductivity of 0.1 W/mK.

7. The fixing unit according to claim 5, wherein the heat insulating layer is made of an elastic member.

8. The fixing unit according to claim 5, wherein the rotatable fixing member includes a conductive layer at an inner side of the heat insulating layer, and the conductive layer has a volume resistivity lower than a volume resistivity of the magnetism regulating layer, and the conductive layer is subject to the magnetic flux, which penetrates the magnetism regulating layer.

9. The fixing unit according to claim 8, wherein the conductive layer is included in a first unit and the magnetism regulating layer is included in a second unit, and the first unit and the second unit are separately provided in the fixing unit.

10. The fixing unit according to claim 5, wherein the heat insulating layer has a thickness of 1 mm or more.

11. The fixing unit according to claim 10, wherein the heat insulating layer has a thickness of 3 mm or more.

12. The fixing unit according to claim 8, wherein the conductive layer includes at least a first conductive layer and a second conductive layer, the first conductive layer is provided closer to a surface of the rotatable fixing member compared to the second conductive layer, the first conductive layer is deformable when subject to pressure from the rotatable pressure applying member, and the first conductive layer is sandwiched by a first heat insulating layer and the second heat insulating layer, formed of an elastic member.

13. The fixing unit according to claim 12, wherein the first heat insulating layer is provided closer to a surface of the rotatable fixing member compared to the second heat insulating layer, and the first heat insulating layer has a lower heat conductivity compared to the second heat insulating layer.

14. The fixing unit according to claim 1, wherein the rotatable fixing member is a fixing roller.

15. The fixing unit according to claim 1, wherein the rotatable fixing member is a fixing sleeve.

16. The fixing unit according to claim 1, wherein the rotatable fixing member is a fixing belt.

17. An image forming apparatus, comprising:

the fixing unit of claim 14.

18. An image forming apparatus, comprising:

the fixing unit of claim 16.

19. The fixing unit according to claim 1, wherein when the temperature T of the magnetism regulating layer is less than the Curie temperature Tc, the magnetic flux generated by the flux generator induces an eddy current on the magnetism regulating layer.

20. The fixing unit according to claim 1, wherein when the temperature T of the magnetism regulating layer is greater than the Curie temperature Tc, the magnetic flux generated by the flux generator induces an eddy current on the core metal.

21. A fixing unit, comprising:

a rotatable fixing belt having a heat generating layer and a silicone rubber layer from an inner side to an outer side of the rotatable fixing belt in such order, the heat generating layer being heated when subject to a magnetic flux generated by a magnetic flux generator;

a magnetism regulating member, not fixed on the rotatable fixing belt, opposing the magnetic flux generator via the rotatable fixing belt intervening between the magnetism regulating member and the magnetic flux generator;

a conductive material member, made of aluminum or aluminum alloy, and opposing the magnetic flux generator via the magnetism regulating member and the rotatable fixing belt, the conductive material member being non-contactable to the magnetism regulating member; and a rotatable pressure applying member configured to contact the rotatable fixing belt and to apply pressure to the fixing belt, the rotatable fixing belt and the rotatable pressure applying member forming a nip therebetween, through which a recording medium is passed through to fix an image on the recording medium, wherein the magnetism regulating member is made of a magnetic material having a Curie temperature of 100 to 300 degrees Celsius.

22. The fixing unit according to claim 21, further comprising a heat insulating member between the magnetism regulating member and the conductive material member.

23. The fixing unit according to claim 22, wherein the heat insulating member is made of an elastic member.

24. The fixing unit according to claim 21, wherein the magnetic flux generator is disposed outside of the rotatable fixing belt.

25. The fixing unit according to claim 24, wherein the magnetism regulating member and the conductive material member are disposed inside of the rotatable fixing belt.

26. The fixing unit according to claim 21, wherein the magnetism regulating member is a single layer, made of alloy material including iron and nickel.

27. The fixing unit according to claim 21, wherein the conductive material member has a volume resistivity lower than a volume resistivity of the magnetism regulating member, and the conductive material member is subject to the magnetic flux, which penetrates the magnetism regulating member.

28. An image forming apparatus, comprising:

the fixing unit of claim 21.

29. A fixing unit, comprising:

a rotatable fixing belt having a heat generating layer, the heat generating layer being heated when subject to a magnetic flux generated by a magnetic flux generator disposed outside of the rotatable fixing belt;

a roller, disposed inside the rotatable fixing belt and being contacted to the rotatable fixing belt, and opposing the magnetic flux generator, the roller having a conductive material layer and a magnetism regulating layer from an inner side to an outer side of the rotatable fixing belt in such order, and the conductive layer and the magnetism regulating layer being disposed each other with non-contactable manner, the conductive material layer is made of aluminum or aluminum alloy;

a fixing support roller disposed inside the rotatable fixing belt; and a rotatable pressure applying member configured to contact the fixing support roller via the rotatable fixing belt, the rotatable fixing belt and the rotatable pressure applying member forming a nip therebetween, through which a recording medium is passed through to fix an image on the recording medium, wherein the magnetism regulating member is made of a magnetic material having a Curie temperature of 100 to 300 degrees Celsius.

30. The fixing unit according to claim 29, wherein the rotatable pressure applying member is a pressure applying roller.

31. The fixing unit according to claim 29, further comprising a tension roller disposed inside of the rotatable fixing belt.

32. An image forming apparatus comprising:

the fixing unit of claim 29.

33. The fixing unit according to claim 21, wherein the magnetism regulating member being disposed at a position that is contactable to the rotatable fixing belt.

* * * * *